United States Patent [19]

Beckers et al.

[11] 3,942,676

[45] Mar. 9, 1976

[54] TEAR-OPEN PACKAGING CONTAINER

[75] Inventors: Hans Beckers, Rheydt; Horst Bonus, Viersen, both of Germany

[73] Assignee: Robert Bosch GmbH, Stuttgart, Germany

[22] Filed: Nov. 5, 1974

[21] Appl. No.: 521,187

[30] Foreign Application Priority Data

Nov. 7, 1973 Germany ..... 2355550

[52] U.S. Cl. ..... 220/270; 229/43; 229/51 TS; 220/359

[51] Int. Cl.[2] ..... B65D 41/32

[58] Field of Search ..... 229/43, 51 R, 51 TS, 48 T; 220/270, 359, 265, 266

[56] References Cited

UNITED STATES PATENTS

| | | | |
|---|---|---|---|
| 3,159,303 | 12/1964 | Betner | 220/270 |
| 3,339,788 | 9/1967 | Lipske | 220/270 |

*Primary Examiner*—George T. Hall
*Attorney, Agent, or Firm*—Edwin E. Greigg

[57] ABSTRACT

A lightweight container for foodstuffs or the like, formed from a multi-layer composite material, typically a sandwich of metal and synthetic plastic foil. A dish-shaped base member and a cover are thermally joined or welded at respective flanges. The cover is provided with weakening score lines which define an area which is to be removed by fracturing the cover material along the score lines when a tab, contiguous with a part of the cover, is pulled up. Each partial section of the tear-open cover has such a tab which is intended to be grasped with the fingers of one hand. The tabs themselves are not joined to the base member of the container and may, in fact, protrude out of the plane of the cover when the container is sealed. The hermetic seal in the region of the free-standing tabs is assured by a platelet, which may be made of the same material as that from which the container is made, but which may have a different composition. This platelet is welded to the inside of the cover, substantially congruent with the region of the starting tabs. To open the package, one of the tabs is grasped and pulled up, resulting in fracture of the material of the cover along the weakening score lines, permitting removal of the associated part of the cover. The procedure is then repeated, if necessary, for removal of any remaining parts of the cover.

10 Claims, 9 Drawing Figures

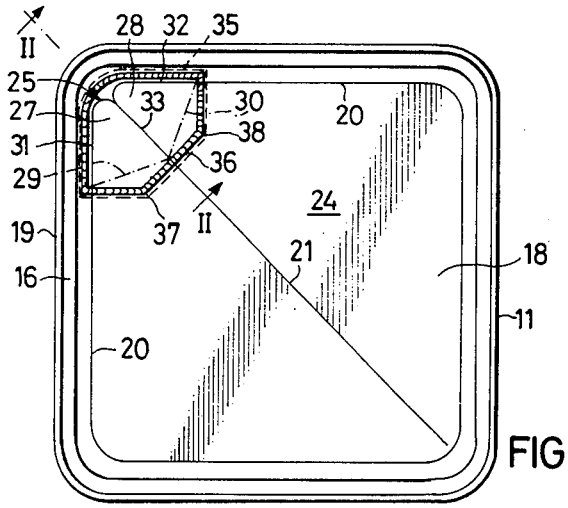
FIG.1
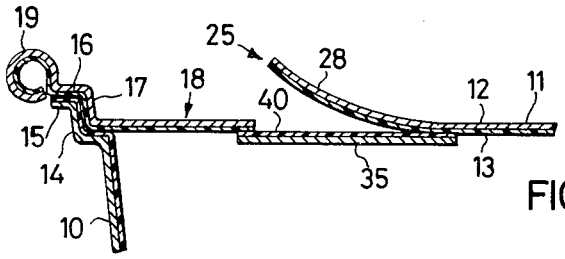
FIG.2
FIG.3
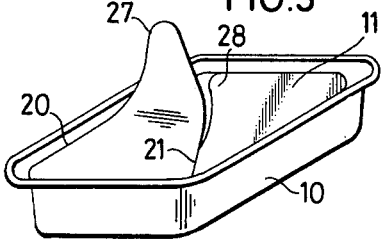
FIG.4
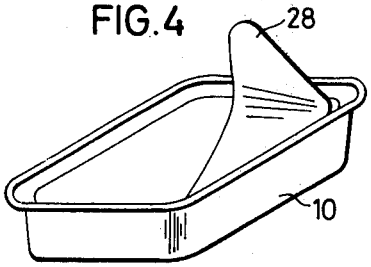

TEAR-OPEN PACKAGING CONTAINER

BACKGROUND OF THE INVENTION

The invention relates to a packaging container comprising a multi-layer composite material of metal and synthetic plastic foils having a wall in which a weakening score line defines a tear-open part and in which a starting region of the tear-open part is punched free. A small plate, which covers the punched-open starting region is tightly sealed to the inside of the wall of the container.

A tear-open container made known, for example, by the German Offenlegungsschrift 2,250,594, has a multilayer cover whose outer layer is a metal foil from which the cover derives its rigidity and tightness. The inside of the metal layer is covered with a synthetic plastic layer whose purpose is to prevent corrosion of the metal by the contents of the container. To facilitate opening the container, the cover has a tear-open portion defined by a weakening score line and is also equipped with a specially formed lever of rigid material which is fixedly attached to the starting portions of the tear-open part. The lever is attached to the cover with a rivet which is formed integrally out of the material of the cover. However, this method of fastening the lever can be used only with a cover material whose metal layer has a certain minimum thickness and rigidity.

Also known are so-called semi-rigid containers or lightweight containers which are deep-drawn out of a thin, metal-plastic composite material into the shape of a dish, and which have an edge flange to which a cover made of the same metal-plastic composite material is welded. The metal-plastic composite material usually consists of an aluminum foil of a thickness of 0.08 mm to 0.2 mm to which a polypropylene foil of a thickness of 0.015 to 0.05 mm is glued. These containers, which are very handy and appealing, are opened by cutting open the cover within the welding bead or by pulling the cover off, whereby the welding bead is peeled apart. Pulling the cover off in this manner is possible only when the plastic layer is very thin, which reduces the reliability of the seal.

OBJECT AND SUMMARY OF THE INVENTION

It is the principal object of the invention to provide so-called lightweight containers whose walls are made of a thin metal-plastic composite material and which include a tear-open device which can be simply manipulated and which permits easy removal of one of the walls of the container.

This object is attained, according to the invention, in that the starting region of the tear-open cover is divided into several tabs and the tear-open part is divided by at least one central weakening score line or groove.

The division of the starting region into several tabs and the disposition of adjacent central weakened score lines has the effect that the first removed strip of the tear-open part of the cover has a narrow beginning and becomes wider only gradually, at a small angle. This brings the advantage that, at the outset, only a small strip of the welding bead needs to be peeled apart and that the actual tearing path does not break out of the weakened score lines during further opening.

Any one of the punched-free tabs of the starting region, which preferably protrude from the level of the cover, can be comfortably grasped between the thumb and index finger of one hand. Subsequent pulling results, in the first instance, in releasing one strip or section of the entire tear-open part in the vicinity of the base of the grasped tab by separating the plastic layers within the welding bead from the platelet. During this action, those portions of the weakened score line which are adjacent to the tab, and which are contiguous with the welding bead, are also torn open. Continued pulling releases a first strip of the tear-open part from out of the cover along the weakened score lines. Subsequently, the other tab is grasped and the strip connected thereto is pulled out of the wall.

Experiments have shown that when using covers consisting of an aluminum foil of a thickness up to 0.2 mm and a synthetic layer of a thickness up to 0.1 mm, the forces required for the initial and continued tearing are well within the region of forces that can be supplied by the thumb and index finger of one hand so that special auxiliary tools are not required.

The invention will be better understood as well as further objects and advantages will become more apparent from the ensuing detailed specification of a preferred, although exemplary embodiment, taken in conjunction with the drawing.

BRIEF DESCRIPTION OF THE DRAWING

FIG. 1 is a top view of the container with a tear-open cover;

FIG. 2 is a view of the container of FIG. 1, seen along the sectional plane II—II in FIG. 1, and drawn on enlarged scale;

FIG. 3 is a perspective view of the container of FIGS. 1 and 2, in partially opened condition;

FIG. 4 is a perspective view of the container, similar to that of FIG. 3;

DESCRIPTION OF THE PREFERRED EMBODIMENTS

Figure 5:
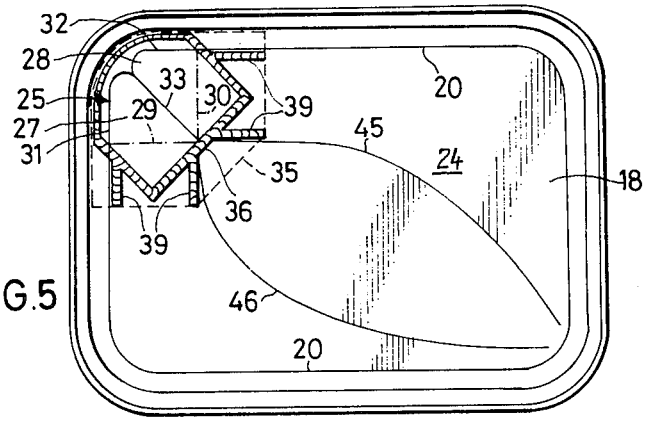
FIG. 5 is a top view of a second exemplary embodiment of a container with a tear-open cover.

The containers depicted in the drawings are used to package high-grade, easily spoilable foodstuffs which are to be stored for a prolonged period of time. Each container comprises a dish- or tray-shaped base member 10 which is deep-drawn in one piece or formed in some other manner and is provided with a cover 11, sealingly fastened to the filling opening of the base member 10. The exemplary embodiments represent so-called semi-rigid or lightweight containers. They are formed from a metal-plastic composite material whose metal layer 12, which is preferably aluminum, has a thickness of approximately 0.08 to 0.2 mm and whose synthetic plastic layer 13, which is preferably polypropylene, has a thickness of approximately 0.015 to 0.05 mm. The above data concerning the thickness of the individual layers of the composite material are intended only as examples and actual values can, in individual cases, deviate widely from these exemplary numbers. The base member 10 and the cover 11 are so formed and connected to one another that the synthetic plastic layer 13 forms the interior of the container.

In all the exemplary embodiments depicted in the drawings, the deep-drawn dish-shaped member 10 is provided with a shoulder 14 at its opening and a horizontally extending flange 15. The cover 11 is also provided with a flange 16 which is in substantial congruence with the flange of the base member 10. The flange 16 lies adjacent to a step 17 in the level surface 18 of the cover 11 which corresponds to the shoulder 14 on the base member 10, so that the cover 11 is suitably received on the base member 10. The base member 10 and the cover 11 are welded together by heat and pressure which is applied in the vicinity of their flanges 15, 16. This process melts and joins the adjacent synthetic plastic layers 13 of the base member 10 and of the cover 11. The exterior edge of the flange 16 of the cover 11 is provided with a rolled rim or crimp 19 which prevents injury to the hands when the container is handled. The container itself can also be provided with a similarly crimped flange. In order to facilitate opening the container, the surface level 18 of the cover 11 is provided with weakened areas 20, 21 which are provided by scoring metal layer 12 to a depth of approximately 30 to 50 percent of its thickness. To insure that the entire surface 18 can be torn open, the weakened area 20 runs parallel to and at a slight distance removed from the step 17 in the surface 18 of the cover 11 and defines a tear-open part 24. The starting region 25 of the tear-open part 24 is punched free and is bent out of the plane of the surface 18, so that it may be grasped by the fingers.

In the exemplary embodiment according to FIG. 1, the starting region 25 comprises two tabs 27, 28, punched free by cuts 31, 32, 33 and located in a corner of the square tear-open part 24. The tabs are symmetrical with respect to the separating cut 33 which lies along the diagonal of the tear-open part 24. A median weakening score 21 is provided along the extension of the cut separating the two tabs 27, 28 and along the diagonal of the tear-open part 24 of the cover 11. This score line 21 divides the tear-open part 24 into two symmetrical partial sections. The division of the tear-open part 24 into several sections brings the advantage that the angle at which a partial section of the tear-open part widens is kept relatively small, which prevents a break-out of the rupture line out of the predetermined weakening scores 20, 21 during the tearing of the cover.

The two tabs 27, 28 provided at the starting region 25 have the form of isosceles triangles whose legs are formed by the separating cuts 31, 32, 33, and whose base is formed respectively, by the lines 29, 30 which connect the ends of the separating cuts 31, 33 and 32, 33, respectively.

The area of the starting region 25 defined by the outer separating cuts 31 and 32 and by the lines 29, 30 is covered by a platelet 35, which is disposed on the inside of the cover 11, and extends over the separating cuts 31, 32 and over the lines 29, 30. The platelet 35 is sealingly attached to the interior coating 13 of the cover 11 in the areas of the cover 11 which are adjacent to the tabs 27, 28, along a closed, frame-shaped welding seam or bead 36. The parts of the seam 36 lying near the outer separating cuts 31, 32 are parallel thereto. In the region of the base of the tab, (lines 29, 30) the seam has apices 37, 38 pointing in the direction in which the tabs 27, 28 are to be pulled. The two legs of each apex 37, 38 intersects with the weakened score lines 20, 21 near the ends of the separating cuts 31, 32, 33 and the tips of the apices 37, 38 are located on the center lines of the two partial sections of the tear-open part 24, extending from the tabs 27, 28. It is to be noted that the ends of the separating cuts 31, 32, 33 are extended as near as possible to the inner edge of the seam 36. Due to this disposition and the shape of the tabs 27, 28, when the tab 27 (or the tab 28) is torn open, it first buckles along its base line 29 (or 30) and the pulling direction is aligned with the center line of a partial section of the tear-open part 24. In addition, when a tab is pulled up, the seam 36 within the region of the apices 37, 38 is not torn open along a straight line, but is continuously separated beginning at two points and the force required to accomplish this separation is very small. The shape of the platelet 35 substantially corresponds to the circumference of the seam 36. In the exemplary embodiment depicted in FIG. 2, the platelet comprises a metal-plastic composite material similar to the material of which the cover 11 and the base member 10 are made. The thermoplastic synthetic layer 40 of the platelet 35 attaches to the plastic layer 13 of the cover 11 and is suitably secured to it along the seam 36 under the influence of heat and pressure.

Figure 7:
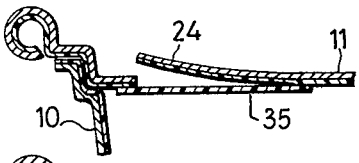
FIG. 7 is a cross section of the starting region of the tear-open device.
Figure 8:
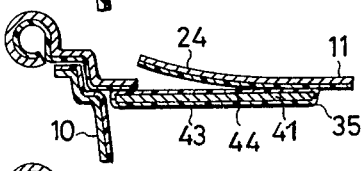
Fig. 8 is a cross-sectional view, similar to that of FIG. 7, of the starting region of the tear-open device.
Figure 9:
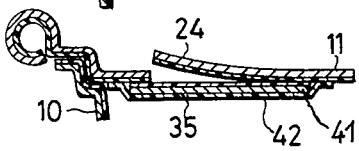
FIG. 9 is a cross-sectional view of still another embodiment showing a structure generally similar to that of FIGS. 7 and 8.

Since the contents of the container should not come in contact with the metallic layer 41 of the platelet 35, the exemplary embodiment according to FIG. 9 provides that the platelet 35 is covered by a thermoplastic synthetic foil 42 which also extends over the edges of the platelet 35 and is sealingly secured to the inside surface of the cover. However, the platelet 35 may also comprise highly rigid plastic material (FIG. 7). It is also possible to make the platelet 35 out of a three-layer composite material in which the two outer layers 43, 44 are plastic and the middle layer 41 is metallic (FIG. 8). When such a platelet 35 is secured to the cover 11, material from the two thermoplastic synthetic layers 43, 44 extrudes beyond the edge of the metallic layer 41 and joins together, thereby covering the edge of the metallic layer 41.

In order that the connection of the platelet 35 with the cover 11 in the welding seam 36 may be easily peeled apart, the synthetic plastic material for the platelet 35 is not identical in nature to the material of the synthetic plastic layer 13 of cover 11. However, since the seam 36 must have satisfactory strength, the two synthetic materials should not be too dissimilar in nature. A useful combination is provided, for example, by a layer of polypropylene on the cover and a layer made from a propylene co-polymer on the platelet 35. Depending on the strength of the desired seam, the plastic layers are either separated within the plane of the seam during the tearing of the cover, or one layer is ripped open and is peeled off from the metal layer during further opening of the container.

The operation of tearing open a container such as depicted in FIGS. 1 and 2 proceeds as follows:

The container is held with one hand and the thumb and index fingers of the other hand grasp one of the two tabs 27, 28 of the starting region 25. Pulling up the tab 27, for example, causes a bend in its base along the connecting line 29 between the two ends of the separating cuts 31, 33. When the tearing operation is now initiated, the portion of the seam 36 lying between the two weakened score lines 20, 21 is continuously separated toward the apex 37, and the tear-open part 24 is peeled off from the platelet 35. At the same time, the region of the weakened score lines 20, 21 adjacent to the separating cuts 31, 33 is fractured. After the apex 37 of the seam 36 has been peeled off, continued pulling on the tab 27 results in the separation of the left partial section of the tear-open part 24 from the container and this section is discarded (FIG. 3). The container is then completely torn open by grasping the second tab 28 and pulling it upwardly, whence, in a manner similar to that described above, the right partial section of the tear-open part 28 is removed from the cover 11 (FIG. 4).

Another exemplary embodiment of the container is shown in FIG. 5 wherein the container has an approximately rectangular base member and wherein the surface 18 of the cover 11 has two curved weakened score lines 45, 46 within the tear-open part. These score lines start at the end of the separating cut 33 between the tabs 27, 28, first diverge from one another and then reconverge in the corner of the cover diagonally opposite to the starting region 25. It is to be especially noted that, when the two weakened score lines 45, 46 lie within the tear-open part 24, the beginning of each of these score lines 45, 46 lies parallel, respectively, to the adjacent part of the scoring line 20 which defines the tear-open part 24. Furthermore, the end points of the separating cuts 31, 32, 33 lie near the seam 36 on the connecting lines 29, 30, respectively, extending transversely to the direction of the initial extent of the pairs of weakened score lines 20/45 and 20/46. Due to this disposition, a breakout of the fracture lines from the prescribed weakened score lines is prevented during the critical starting phase of the tearing operation by means of one of the tabs 27, 28. Furthermore, the disposition of the two weakened score lines 45, 46 within the tear-open part 24 brings the advantage that each partial tear-open section lying, respectively, between these median weakened score lines 45, 46 and the edge weakened score line 20, is progressively enlarged in approximately the same measure. Even though, during the removal of the tear-open part 24 of the cover 11, only one of the two central weakened score lines 45, 46 is fractured, this disposition of the weakened score lines makes it possible to omit instructing the consumer as to which of the two tabs 27, 28 he is to grasp and pull up first. In both possible cases, the conditions of the start and continuation of the tearing operation are equally satisfactory. The form of the tear-open tabs 27, 28 and of the seam 36 benefits from an arrangement in which the ends of the separating cuts 31, 32, 33 as well as the points of intersection of the seam 36 with the weakened score lines 20, 21 and 20, 45, 46 adjacent to the separating cuts, lie, respectively, on lines 29, 30 which extend transversely to the desired pulling direction, i.e., transverse to the center line of the tear-open part 24 or of its partial surfaces.

In this exemplary embodiment, the platelet 35 may have a shape generally corresponding to the circumference of the seam 36. However, it may also extend beyond the seam 36 in the direction of the center of the container, as is shown in FIG. 5. The overhanging portion may be partly sealed to the tear-open part 24 of the cover by means of suitably adhered seams 39 extending from the main seam 36 in the manner of fingers. Preferably, the seamed area 39 runs parallel to the initial regions of the weakened score lines 20, 45 and 46 and at a small distance therefrom within the tear-open sections defined by the weakened score lines. Such seams also prevent a deviation of the fracture line out of the weakened score lines during the critical starting phase of the tearing operation.

Figure 6:
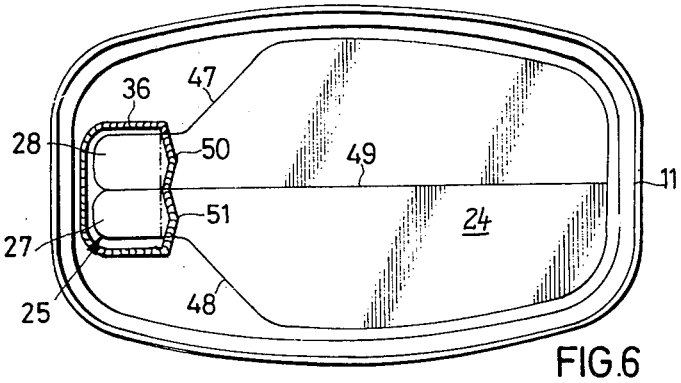
FIG. 6 is a top view of a third exemplary embodiment of a container with a tear-open cover.

The further exemplary, preferred embodiment of a container, according to FIG. 6, has a basically oval shape with two opposite, short, straight sides. The starting region 25 in this container lies adjacent to and in the center of a short side. The tabs 27, 28 are approximately rectangular. Lying adjacent to the separating cuts of the tabs 27, 28 are weakened score lines 47, 48, 49 of which the two outer score lines 47, 48 at first extend in straight lines with respect to the separating cuts of the tabs 27, 28 and then proceed obliquely toward the edge of the cover and finally run parallel thereto. The third weakened score line 47 symmetrically divides the length of the tear-open part 24. The closed seam 36, which connects the platelet to the cover 11 while covering the starting region 25, has apices 50, 51 which point in the pulling direction of the tabs 27, 28 and whose apex angles are more obtuse than those in the exemplary embodiment according to FIG. 5., i.e., somewhat more similar to those of the exemplary embodiment depicted in FIG. 1.

For completeness, it is to be noted that the seam which fastens the covering platelet within the starting region need not have only one apex within the region of the base of the tab, but may have several apices so that a tearing or peeling of the seam within this region beginning at a point or points may take place without the exertion of great force.

We claim:

1. A packaging container formed from a composite material having a cover element including top and bottom walls the latter being provided with a circumferential primary score line defining a portion capable of being torn away from said cover and further including an initial point of fracture, a plate-like means secured to the surface of said bottom wall adjacent to the point of initial fracture of said score line, the improvement comprising plural juxtaposed tab means having portions arranged to overlie said plate-like member and secondary score line means communicating with said tab means defining a limited area to be removed from said cover upon fracturing at least one of said tab means from said plate-like means.

2. A packaging container as claimed in claim 1, in which the said cover element comprises a square body having a plurality of corner portions and the tab means is arranged to terminate above said plate-like means and adjacent to at least one of said corner portions.

3. A packaging container as claimed in claim 1, wherein said cover element comprises a rectangular body having a plurality of corner portions and the tab means is arranged to terminate above said plate-like means and adjacent to at least one of said corner portions.

4. A packaging container as claimed in claim 1, in which the cover element comprises an oval body having at least four corners and the tab means is arranged to terminate above said plate-like means and adjacent to at least one of said corner portions.

5. A packaging container as claimed in claim 1, in which the said secondary score line divides the cover element into at least two equal zones.

6. A packaging container as claimed in claim 1, in which the secondary score line divides the cover portion into a plurality of zones.

7. A packaging container as claimed in claim 6, wherein the said zones are of unequal area.

8. A packaging container as claimed in claim 1, in which the point of initial fracture and separation of the tab means from the plate-like member occurs along broken lines.

9. A packaging container as claimed in claim 1, in which said plate-like member comprises a laminated structure having oppositely disposed plastic surface areas at least one of which is capable of being welded to the bottom wall of said corner element.

10. A packaging container as claimed in claim 1, in which the said tab means have a termini and the line of initial fracture and separation thereof from the plate-like member occurs along a divergent line, said divergent line extending in opposition to said termini of said tab means.

* * * * *